United States Patent [19]

Urquhart

[11] 4,360,389

[45] Nov. 23, 1982

[54] ZIRCONIUM ALLOY HEAT TREATMENT PROCESS

[75] Inventor: Andrew W. Urquhart, Scotia, N.Y.

[73] Assignee: General Electric Company, Schenectady, N.Y.

[21] Appl. No.: 164,883

[22] Filed: Jun. 30, 1980

Related U.S. Application Data

[63] Continuation of Ser. No. 853,048, Nov. 21, 1977, abandoned, which is a continuation of Ser. No. 632,478, Nov. 17, 1975, abandoned.

[51] Int. Cl.[3] ..... C21D 1/00; C22F 1/18

[52] U.S. Cl. ..... 148/11.5 F; 148/12.7 B; 148/133; 376/900

[58] Field of Search ..... 148/11.5 F, 12.7 B, 148/32.5, 133, 158; 75/177

[56] References Cited

U.S. PATENT DOCUMENTS

| | | | |
|---|---|---|---|
| 3,271,205 | 9/1966 | Winton et al. | 148/133 |
| 3,287,111 | 11/1966 | Klepfer | 75/177 |
| 3,664,825 | 5/1972 | Bergqvist et al. | 75/177 |
| 3,804,708 | 4/1974 | Nilson | 75/177 |
| 3,865,635 | 2/1975 | Hofvenstam et al. | 148/11.5 F |
| 4,219,372 | 8/1980 | Fang | 148/11.5 F X |
| 4,238,251 | 12/1980 | Williams et al. | 148/133 |

FOREIGN PATENT DOCUMENTS

| | | | |
|---|---|---|---|
| 252518 | 5/1963 | Australia | 148/11.5 F |

OTHER PUBLICATIONS

Chirigos et al., "Development of Zircaloy-4", Fuel Element Fabrication, Symposium, Vienna, May 10-13, 1963, pp. 19-53.

Östberg et al., "Structure Transformations in Zircaloy-2 During Hot Working Processes, *Journal of Nuclear Materials,* 5 (No. 1), 1962, pp. 120-127.

"Structure and Properties of Zirconium Alloys" by Ivanov et al. [*Proceedings of the Second United Nations International Conference on the Peaceful Uses of Atomic Energy,* Geneva, Sep. 1-13, 1958, pp. 45, 46].

*Primary Examiner*—Peter K. Skiff

*Attorney, Agent, or Firm*—Leo I. MaLossi; James C. Davis, Jr.

[57] ABSTRACT

Zirconium-base alloy channels, fuel cladding tubes and other nuclear reactor structural components having unique resistance to accelerated pustular corrosion in the boiling water reactor environment are produced by a sequence of heat treatments causing segregation of intermetallic particulate precipitate phase in two dimensional arrays of particles of diameter from 100 to 400 Angstroms located along grain boundaries and subgrain boundaries throughout the alloy body.

6 Claims, 3 Drawing Figures

ZIRCONIUM ALLOY HEAT TREATMENT PROCESS

This is a continuation of application Ser. No. 853,048, filed Nov. 21, 1977 (now abandoned), which in turn is a continuation of application Ser. No. 632,478, filed Nov. 17, 1975 (now abandoned).

The present invention relates generally to materials of construction of nuclear reactors and is more particularly concerned with a novel method of enhancing the ability of zirconium-base alloys to resist corrosive attack under boiling water reactor operating conditions, and with unique structural components produced through the use of what method.

This invention is related to that disclosed and claimed in copending patent application Ser. No. 552,794, filed Feb. 25, 1975 now U.S. Pat. No. 4,238,251, in the names of Cedric D. Williams, Andrew W. Urquhart, James L. Walker, Richard A. Proebstle and Timonthy J. Black, which is predicated on the concept of heat treating a zirconium-base alloy body to cause redistribution of the intermetallic particulate phase with resulting substantial increase in resistance to pustular corrosion under boiling water reactor service conditions.

This invention is also related to that disclosed and claimed in copending patent application Ser. No. 735,023, filed Oct. 22, 1976 (now abandoned) as a continuation-in-part of application Ser. No. 552,795, filed Feb. 25, 1975 (now abandoned), in the names of Allan J. Kiesler, Alan C. Rockwood and Peter G. Frischmann which implements the method of application Ser. No. 552,794, abandoned in a zone heat treating process and apparatus based on the concept of traversing the length of a workpiece with a hot zone of fixed length in which the maximum temperature is maintained by regulation of power input automatically in response to fluctuations in infrared radiation from a portion of the workpiece axially spaced from the hot zone.

BACKGROUND OF THE INVENTION

Important requirements for materials used in boiling water nuclear reactor construction include low absorption for thermal neutrons, corrosion and stress-corrosion resistance and mechanical strength. Zirconium-base alloys sufficiently satisfy these requirements that they are widely used for such purposes, "Zircaloy-2" (containing about 1.5 percent tin, 0.15 percent iron, 0.1 percent chromium, 0.05 percent nickel and 0.1 percent oxygen) and "Zircaloy-4" (containing substantially no nickel and about 0.2 percent iron but otherwise similar to Zircaloy-2) being two of the important commercial alloys commonly finding such use. These alloys, however, are not nearly all that one would desire, particularly in respect to accelerated pustular corrosion which occurs under boiling water reactor normal operating conditions and results in spalling of thick oxides from channels and thickening of oxides on fuel rods. The spalling of oxide flakes leads in some instances to development of high radiation fields in locations where the flakes collect; in addition, the extra loss of metal thickness due to the accelerated oxidation process requires an undesirable increase in design allowances for corrosion.

Efforts heretofore to solve this particular problem have to our knowledge met with no success, although the general subject of corrosion of such alloys has long been of active interest to experts in the field. Thus, in U.S. Pat. No. 3,005,706, it is proposed that from 0.03 to 1.0 percent of beryllium be added to zirconium alloys intended for use in conventional boilers, boiling water reactors and similar apparatus to enhance corrosion resistance to high temperature water. Similarly, in U.S. Pat. Nos. 3,261,682 and 3,150,972, cerium and/or yttrium and calcium, respectively, are proposed as zirconium alloy additions in like proportions of the same purpose. Accounts and reports of the long-term results of such compositional changes are sparse, however, and commercial zirconium alloys do not include these additional constituents.

SUMMARY OF THE INVENTION

This invention, which is predicated on my discovery and new concept to be described, provides an answer to the accelerated pustular corrosion problem in the form of a heat treatment process which is expected to at least approximately double the corrosion-limited lifetime of zirconium-base alloy boiling water reactor structural components. Moreover, this result can be obtained consistently and at relatively small additional cost, particularly through the use of the novel zone heat treating process and apparatus disclosed and claimed in the above-referenced copending patent application Ser. No. 735,023, abandoned.

The foregoing surprising corrosion-resistance properties were discovered through the use of an accelerated test which provides a good correlation with in-reactor performance data. Thus, the test specimens were subjected to high temperature (about 500° C.), high pressure (about 1500 psi) steam in autoclave experiments running from 22 to 24 hours, and then visually examined and measured for weight gain.

My discovery is that there is a strong correlation between a particular microstructural characteristic and resistance to corrosion in boiling water reactor environments. In particular, I have found that corrosion resistance at least equal to that obtained through the use of the method disclosed and claimed in referenced patent application Ser. No. 552,794, abandoned can consistently be produced in zirconium-base alloys by a process including a high temperature solution treatment and rapid quench followed by a heat-aging step which results in precipitation of a second phase in the form of particles ranging from about 100 to 400 Angstroms in size. These particles of intermetallic material [$Zr(Cr,Fe)_2$ in Zircaloy-4 and both $Zr(Cr,Fe)_2$ and $Zr_2(Ni,Fe)$ in Zircaloy-2] are segregated in two-dimensional arrays along grain- and sub-grain boundaries instead of being in the usual condition of generally uniform distribution and isolated and separated from each other.

Our concept is to use this discovery to greatly increase the service life of a zirconium-base alloy body by preparing it to intermediate or to substantially finished form as a boiling water reactor channel, or as a tube for nuclear fuel cladding, or as a fuel rod spacer for use in a reactor channel, and heating it to transform substantially completely from alpha (hexagonal close packed) to beta (body centered cubic) phase, quenching it to produce a very fine Widmanstattan or martensitic structure without intermetallic particles as the iron, chromium and nickel are maintained in solution, and finally annealing it at a relatively low temperature to cause precipitation of intermetallic particles along the grain boundaries and sub-grain boundaries.

In principle, it is possible to perform the initial solution annealing treatment at a temperature where the alpha phase transforms only partly to the beta phase (i.e., a treatment in the alpha+beta phase field), since such treatments result in dissolution of the intermetallic precipitates. However, it is our experience that the usual rapid quenching procedures (such as a water quench) are not fast enough to retain the iron, chromium and nickel in solution following these lower temperature anneals. In these cases, the precipitates tend to form during the quench (as in copending application Ser. No. 552,794, abandoned) rather than during the subsequent thermal aging.

The zirconium-base alloy body treated in this manner in addition to having significantly enhanced resistance to corrosion has desirable mechanical characteristics attributable to the fine microstructure resulting from the quenching operation followed by the heat-aging step.

It is important in carrying out this invention to avoid processing operations subsequent to the foregoing heating and quenching steps such as hot and cold rolling and annealing which will result in elimination of the two dimensional arrays of precipitate particles throughout the alloy body. Rehomogenizing of those particles in any manner can lead to loss of the desired corrosion-resistance characteristic.

This new concept of mine also differs importantly from the prior art notion of subjecting Zircaloy channels and tubes for use in boiling water reactors to heat treatment in the beta temperature range at an early stage of their fabrication so as to eliminate any undesirable dendritic or other segregate phase. Although quenching may have followed such heat treatment, any beneficial effects in the direction of the present invention were quickly lost in subsequent hot and cold working an annealing operations which were a necessary part of the fabrication schedule and different from the forming, straightening, grit blasting, pickling and stress—relief annealing steps comprising the finishing (as distinguished from the fabrication) operations, which do not eliminate or diminish the foregoing beneficial effects.

In its method aspect, this invention comprises the steps of heating a zirconium alloy body to a temperature in the beta phase region and maintaining it there until the alpha phase transforms substantially completely to the beta phase, then cooling the body below about 400° C. without precipitating intermetallic phase dissolved during the heating step, thereafter reheating to an intermediate temperature to cause precipitation of the intermetallic phase in the form of particles from about 100 to 400 Angstroms in diameter along grain- and sub-grain boundaries. Preferably, the solution heat treatment is carried out at temperature between about 1000° C. and 1100° C. in about three seconds to one minute, these temperatures being somewhat above the alpha+beta to beta transformation temperatures of the alloys described above. As a practical matter, temperatures above 1100° C. are not desirable because detrimental grain growth and excessive contamination may occur. Similarly, there is nothing to be gained and there is some risk in prolonging the solution heat treatment beyond one minute for the same reasons.

The quenching step is carried out so as to bring the temperature of the solution heat treated body from the beta transformation range to about room temperature, water being preferred for this purpose although other media such as oil are within the scope of this invention. Using water and the apparatus disclosed and claimed in referenced patent application Ser. No. 735,023, quenching rates of more than 800° C. per second can be obtained to prevent precipitation of any significant amount of intermetallic phase.

The aging or precipitation heat treatment is accomplished by reheating the quenched body to 400° C. to 600° C. for two to four hours and then cooling as desired to about room temperature. The duration of the heat treatment will be greater at lower temperature for the same desired result, and no substantial advantage is to be gained by prolonging this operation beyond the time when precipitation of the intermetallic phase is substantially complete. While temperatures up to the alpha transformation temperature (about 825° C.) may be used, there is a marked tendency for the desired microstructure to break down at temperatures above about 600° C. with resulting loss of corrosion resistance in the ultimate alloy body. On the other hand, at temperatures below about 400° C., the intermetallic material does not precipitate or does so at a rate much too slow for practical purposes.

In its product or article aspect, the structural component of this invention is a zirconium-base alloy and has special utility in a boiling water reactor by virtue of its resistance to accelerated pustular corrosion. As indicated above, the alloy contains tin, iron and chromium and may additionally contain nickel, and it includes the zirconium—iron—chromium intermetallic compound, $Zr(Cr,Fe)_2$, and may also contain $Zr_2(Ni,Fe)$ in the form of a particulate precipitate. The microstructure of the article is characterized by segregation of precipitate particles of diameter from about 100 to 400 Angstroms in two dimensional arrays along grain boundaries and sub-grain boundaries distributed throughout the component.

DESCRIPTION OF THE DRAWINGS

The novel features of this invention are illustrated in the drawings accompanying and forming a part of this specification, in which.

DETAILED DESCRIPTION OF THE INVENTION

Figure 1:
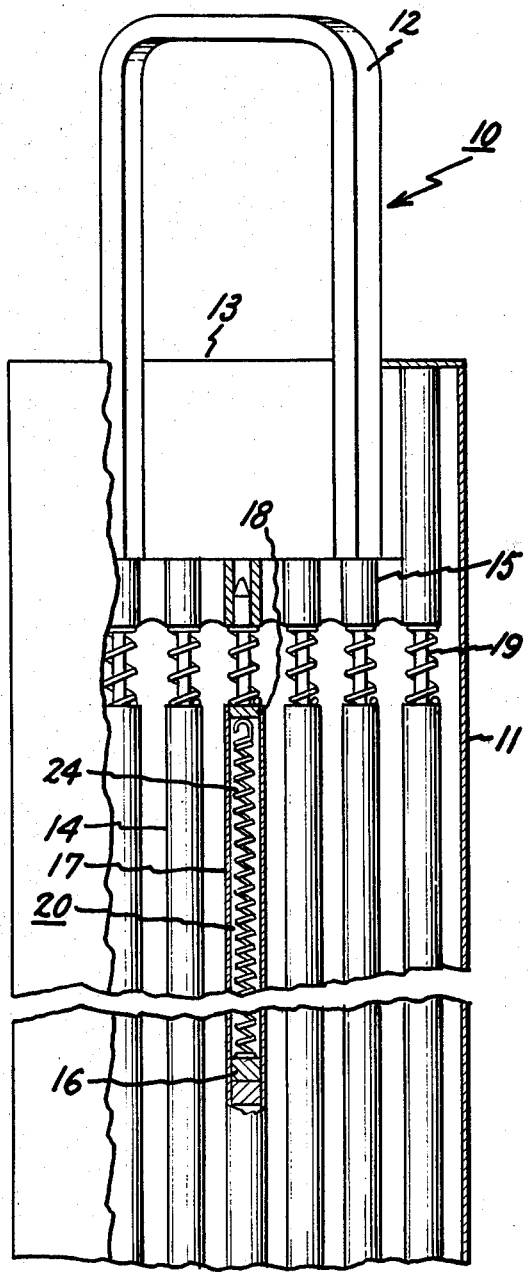
FIG. 1 is a partial cutaway sectional view of a nuclear reactor fuel assembly incorporating structural members embodying this invention in preferred form.
Figure 2:
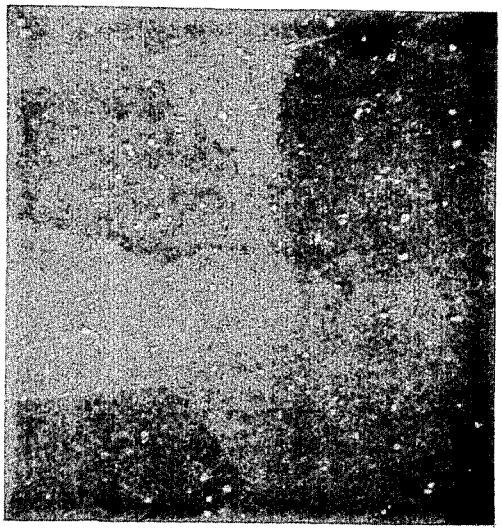
FIG. 2 is a scanning electron photomicrograph (2000×) of a conventional zirconium-base alloy, showing the distribution of particulate intermetallic phase.

A primary application of this invention is in the fabrication of nuclear fuel assemblies such as that illustrated in the partial cutaway sectional view of FIG. 1. Assembly 10, as illustrated, is typical of the boiling water reactor fuel assembly design and consists of a tubular flow channel 11 of generally square cross section provided at its upper end with lifting bale 12 and at its lower end with a nose piece (not shown due to the lower portion of assembly 10 being omitted). The upper end of channel 11 is open at 13 and the lower end of the nose piece is provided with coolant flow openings. An array of fuel elements or rods 14 is enclosed in channel 11 and supported therein by means of upper end plate 15 and a lower end plate (not shown due to the lower portion being omitted), and rods 14 are maintained in spaced relation to each other by spacer grids (not shown) through which the rods extend located at intervals along the length of the assembly and secured to the rods 11. The liquid coolant ordinarily enters through the openings in the lower end of the nose piece, passes upwardly around fuel elements 14, and discharges at upper outlet 13 in a partially vaporized condition for boiling water reactors or in an unvaporized condition for pressurized reactors at an elevated temperature.

The nuclear fuel elements or rods 14 are sealed at their ends by means of end plugs 18 welded to the cladding 17, which may include studs 19 to facilitate the mounting of the fuel rod in the assembly. A void space or plenum 20 is provided at one end of the element to permit longitudinal expansion of the fuel material and accumulation of gases released from the fuel material. A nuclear fuel material retainer means 24 in the form of a helical member is positioned within space 20 to provide restraint against the axial movement of the pellet column, especially during handling and transportation of the fuel element.

The fuel element is designed to provide an excellent thermal contact between the cladding and the fuel material, a minimum of parasitic neutron absorption, and resistance to bowing and vibration which is occasionally caused by flow of the coolant at high velocity.

Channel 11, fuel element or cladding 14 and spacer grids (not shown) are produced in accordance with this invention by a method which includes in addition to the usual channel and tube-forming operations final heat treatment in which the alpha phase is transformed substantially completely to beta phase and the body is quenched and then reheated to a relatively low temperature to cause precipitation of very fine particles of dissolved intermetallic phase along grain- and sub-grain boundaries. The rate at which the workpiece is heated to the beta phase transformation temperature range and the temperature level reached in that range are matters of choice, but both the minimum time in that range and the minimum cooling rate from the threshold (965° C. -990° C.) of the range are highly critical. Thus, the new advantages and results of this invention cannot be consistently obtained unless the particulate precipitate phase is in the very fine condition previously described; and I have found that such condition cannot be established to the extent necessary to increase by a factor of approximately two or more the corrosion-limited lifetimes of channels and cladding unless the time at temperature above the alpha-to-beta transus temperature is at least about 3 seconds and the cooling rate to below about 400° C. is rapid enough to avoid precipitation of the intermetallic phase. The minimum required cooling rate for this purpose is not well established; however, a rate of 800° C. per second appears to be adequate.

The atmospheres in which the solution and precipitation heat treatments are conducted are not critical. Thus, air is suitable in both and, in fact, represents the best practice of this invention carried out on a commercial scale as long as the oxide developed during heat treatment is removed in final processing.

The present novel method and products are set forth in detail in the following illustrative, but not limiting, examples of the best practice of this invention.

EXAMPLE I

Figure 3:
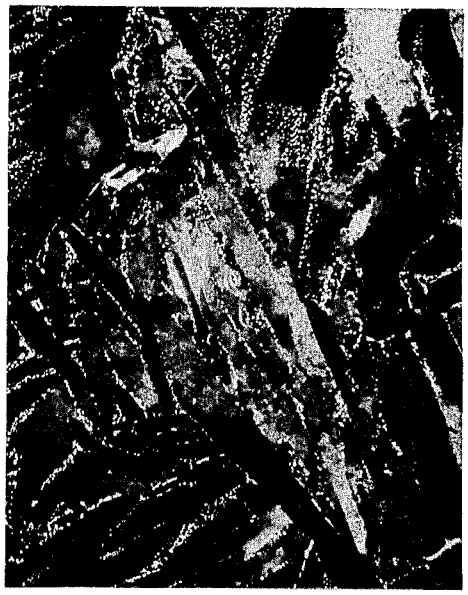
FIG. 3 is a transmission electron photomicrograph (20,000×) of the FIG. 2 alloy following heat treatment in accordance with this invention.

A test strip of Zircaloy-4 ASTM B352 Grade RA2 of 80-mil gauge thickness was heated in argon to 1000° C. for five minutes and then water-quenched to 20° C. The strip was then cut into two parts, one of which was reheated to 500° C. for 24 hours. It was air-cooled once again to 20° C. and then both parts were subjected to transmission electron microscopic examination. FIG. 3 shows the fine particles developed during the aging process, no such particles being present after quenching and before aging. Similar results where obtained using shorter aging treatments of about four hours duration.

A sample of the strip material which had been aged as described above was then subjected to 500° C., 1500 psi steam for 24 hours along with a sample of the same alloy which had not been heat treated. Visual examination of the two specimens on removal from the test autoclave on conclusion of this accelerated corrosion test revealed that substantial corrosion resistance was obtained through the use of the heat treatment process of this invention, there being only minor, uniform oxide growth on the treated one while the untreated one was heavily corroded in the manner characteristic of zirconium alloy bodies subject for protracted periods to boiling water nuclear reactor conditions.

EXAMPLE II

A boiling water reactor channel of Zircaloy-4 (ASTM B352 Grade RA2) of 120 mil thickness was heat treated by passing it through an induction heating apparatus similar to that described in referenced application Ser. No. 735,023, abandoned. The time within the desired temperature range of 1000° to 1100° C. was approximately three seconds. The channel was quenched by spraying water on its exterior surface below the elevation of the heating coils. Subsequent examination by transmission electron microscopy showed that precipitation of intermetallic particles did not occur near the external surfaces, and that this material responded to aging treatments in a similar manner to that described in Example I and illustrated in FIG. 3. While some precipitation occurred near the inner (uncooled) surface of the channel, it is believed that this could be eliminated by further improvements in the external quenching spray, or by direct spray quenching of the internal surfaces.

Throughout this specification and the appended claims where ratios or proportions are stated, reference is to the weight basis unless otherwise specified.

Those skilled in the art will understand from the above description of this invention in general and specific terms that the invention is applicable to zirconium-base alloy strip material as well as to channels and other structural components fabricated therefrom. The important point is that hot or cold working and annealing operations which tend to rehomogenize that microstructural segregation produced by the process of this invention should be avoided in subsequent fabrication operations. Channels or spacers can, however, be fabricated from strip processed in accordance with this invention method without the necessity for such hot or cold rolling and annealing steps and without causing such rehomogenization.

What I claim as new and desire to secure by Letters Patent of the United States is:

1. In the method or producing a boiling water reactor structural component of an alloy of zirconium substantially free of niobium and containing alloying components selected from the group consisting of tin, iron, chromium, nickel and oxygen, which method includes hot and cold working and annealing steps comprising a fabrication schedule, the combination of the steps of heating said structural component at a temperature and for a time sufficient for substantially completely transforming alpha phase to beta phase and dissolving substantially all intermetallic particles, cooling said structural component to about room temperature at a rate rapid enough to prevent intermetallic phase dissolved during the heating step from precipitating, subsequently heating said structural component to an intermediate temperature to cause precipitation of the intermetallic phase in the form of particles from about 100 to 400 Angstroms in diameter in two dimensional arrays along grain boundaries and sub-grain boundaries and retaining substantially all said intermetallic phase particles in said boundaries during any subsequent processing steps executed through and including installing said structural component in a boiling water reactor.

2. The method of claim 1 in which the alloy contains substantially no nickel and about 1.5 percent tin, about 0.2 percent iron, about 0.1 percent chromium, about 0.1 percent oxygen and balance zirconium, and in which the intermetallic particulate phase is $Zr(Cr,Fe)_2$.

3. The method of claim 1 in which the alloy contains, by weight, about 1.5 percent tin, about 0.15 percent iron, about 0.1 percent chromium, about 0.05 percent nickel and about 0.1 percent oxygen, balance zirconium.

4. The method claim 1 in which the structural component is maintained above the alpha+beta to beta transformation temperature for at least three seconds.

5. The method of claim 1 in which the structural component is heated to 1000° C. to 1100° C. for three seconds to one minute and then after quenching to about room temperature is heated to 400° C. to 600° C. for two to four hours.

6. The method of claim 5 in which the quenching step is carried out with water and the structural component is cooled to about room temperature from 1000° C. to 1100° C. at the rate of greater than 800° C. per second.

* * * * *